US005141846A

United States Patent [19]

Fickie et al.

[11] Patent Number: 5,141,846

[45] Date of Patent: Aug. 25, 1992

[54] METHOD FOR PREPARING PHOTOGRAPHIC EMULSION

[75] Inventors: Kenneth E. Fickie, Natick; Michael R. Lee, Billerica, both of Mass.

[73] Assignee: Polaroid Corporation, Cambridge, Mass.

[21] Appl. No.: 599,470

[22] Filed: Oct. 18, 1990

[51] Int. Cl.[5] ..... G03C 1/02

[52] U.S. Cl. ..... 430/569; 430/567

[58] Field of Search ..... 430/569, 567

[56] References Cited

U.S. PATENT DOCUMENTS

| | | | |
|---|---|---|---|
| 2,222,264 | 11/1940 | Nietz et al. | 95/7 |
| 2,448,060 | 8/1948 | Smith et al. | 95/7 |
| 3,320,069 | 5/1967 | Illingsworth et al. | 96/107 |
| 3,628,960 | 12/1971 | Philippaerts et al. | 96/124 |
| 4,225,666 | 9/1980 | Locker et al. | 430/569 |
| 4,434,226 | 2/1984 | Wilgus et al. | 430/569 |
| 4,439,520 | 3/1984 | Kofron et al. | 430/434 |
| 4,643,966 | 2/1987 | Maskasky | 430/567 |
| 4,791,053 | 12/1988 | Ogawa | 430/569 |
| 4,828,972 | 5/1989 | Ihama et al. | 430/596 |

*Primary Examiner*—Charles L. Bowers, Jr.
*Assistant Examiner*—Thorl Chea
*Attorney, Agent, or Firm*—Philip G. Kiely

[57] ABSTRACT

A method for manufacturing a photosensitive silver halide emulsion which comprises the steps, in sequence, of forming silver bromide grains which have predominantly (111) crystal faces or mixed halide grains of any morphology in the presence of a hydrophilic colloid; contacting said grains with a silver halide complexing agent which also forms insoluble silver salts; spectrally sensitizing said grains with an aggregating spectral sensitizing dye prior to or simultaneously with chemical sensitization of said grains wherein said spectral sensitization takes place the presence of said silver halide complexing agent.

15 Claims, 4 Drawing Sheets

METHOD FOR PREPARING PHOTOGRAPHIC EMULSION

FIELD OF THE INVENTION

The present invention is directed to a method for manufacturing a spectrally and chemically sensitized silver halide emulsion and, more particularly, to a method for manufacturing an emulsion of enhanced photographic sensitivity.

BACKGROUND OF THE INVENTION

Silver halide emulsions are generally prepared by precipitating silver halide grains in a hydrophilic colloid, such as gelatin, by the reaction of a silver salt and a halide salt. The thus-formed emulsion is then physically ripened (grain-growing), washed, to remove the soluble salts from the precipitation step and then chemically sensitized, most often with gold and sulfur, to enhance sensitivity to incident light, and then spectrally sensitized to a particular region of the spectrum.

While the above-described sensitization, first chemical, followed by spectral, is the most common sequence of steps employed, it is known in the art to add spectral sensitizing dyes to the emulsion prior to chemical sensitization. For example, U.S. Pat. No. 3,628,960, issued Dec. 21, 1971 (Phillippaerts), discloses adding the sensitizing dye during preparation of the emulsion and can even be added with one or more of the ingredients used in the formation of the grains.

Similarly, U.S. Pat. No. 4,225,669, issued Sep. 30, 1980 (Locher) discloses adding the spectral sensitizing dye after nucleation is complete and before completion of silver halide precipitation. U.S. Pat. No. 4,828,972, issued May 9, 1989 (Ihama), is directed to a method for manufacturing a silver halide emulsion wherein spectral sensitizing dye is added during preparation of the emulsion prior to the desalting step.

It is also known in the art to add thiocyanates to emulsions at various stages of preparation. For example, U.S. Pat. No. 2,222,264, issued Nov. 19, 1940 (Nietz), is directed to the incorporation of metal and/or ammonium thiocyanates during precipitation, during the first digestion, or during the melting out and the second digestion. Increased sensitivity throughout the entire region of sensitivity is obtained.

U.S. Pat. No. 2,448,060, issued Aug. 31, 1948 (Smith), is directed to incorporating sulfur sensitizers at any stage of the preparation of the emulsion. For example, Example 1 discloses the addition of sodium thiocyanate after precipitation of the silver halide but prior to digestion.

U.S. Pat. No. 3,320,069, issued May 16, 1967 (Illingsworth), is directed to the preparation of silver halide emulsions wherein a water-soluble thiocyanate is supplied to the silver halide after the dispersion is formed but prior to it being washed.

U.S. Pat. No. 4,439,520, issued Mar. 27, 1984 (Kofron), discloses a method for preparing tabular grain emulsions (e.g., col. 67, 1. 44, et. seq.) wherein digestion of the grains takes place in the presence of sodium thiocyanate. After said digestion the emulsion was washed which removed the sodium thiocyanate. Spectral sensitization and then chemical sensitization was carried out on the washed emulsion.

BRIEF DESCRIPTION OF THE INVENTION

Figure 1:
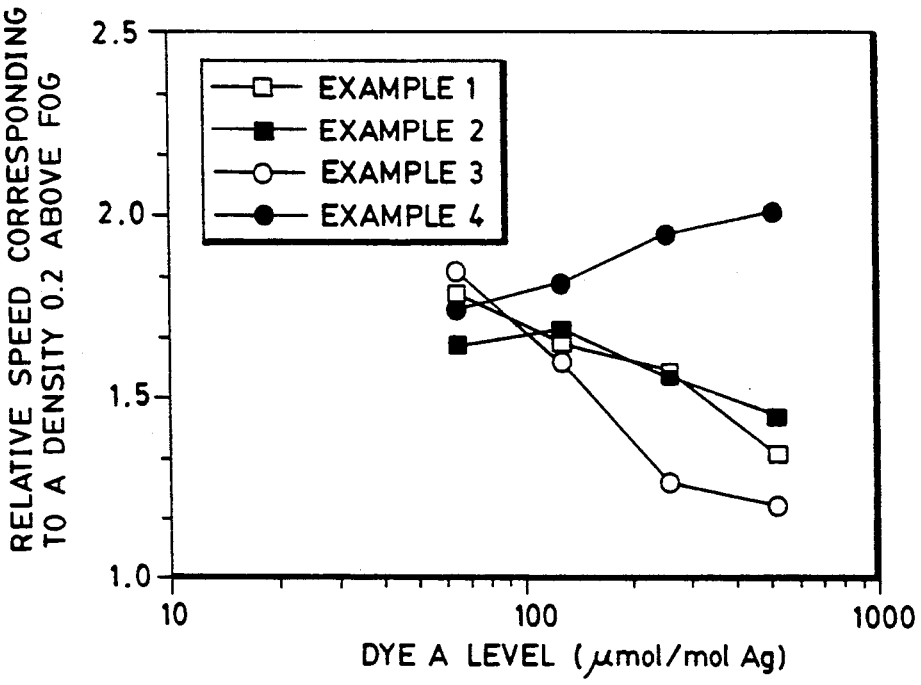
FIGS. 1-2 show plots of speed vs. sensitizing dye levels in high aspect ratio silver bromide tabular grain emulsions comparing the emulsions of the present invention with control emulsions.

The present invention is directed to a method for manufacturing a silver halide emulsion which comprises the steps, in sequence, of a) forming silver halide grains which are silver bromide having predominantly (111) crystal faces or mixed halides of any morphology in the presence of a hydrophilic colloid;

b) contacting said grains with a silver halide complexing agent which is also capable of forming an insoluble salt;

c) adding at least a first aggregating spectrally sensitizing dye to said grains; and d) chemically sensitizing said grains subsequent to step c) or simultaneous with step c) wherein step c) is carried out in the presence of said silver halide complexing agent. The invention is also directed to a silver halide emulsion prepared by said method.

DETAILED DESCRIPTION OF THE INVENTION

By means of the novel process of the present invention, an emulsion is prepared which provides unexpectedly advantageous results with respect to speed compared to control emulsions. Thus, the novel method of the present invention which consists of a specific sequence of steps provides a method for obtaining an emulsion of enhanced sensitivity without any countervailing deleterious results.

The above-described enhanced sensitivity is achieved by carrying out the novel procedure of the present invention to prepare photosensitive silver halide emulsions. The emulsions within the scope of the present invention include silver bromide grains which are bound by predominantly (111) crystallographic faces. Silver halide grains of mixed halide composition may be prepared by the novel method of the present invention having any crystal morphology. Thus, it is intended that mixed halide emulsions within the scope of the present invention may be monodisperse or polydisperse and may include tabular grain emulsions, i.e., emulsions wherein the grains exhibit an aspect ratio greater than 1;

emulsions containing non-tabular grains; and core-shell emulsions. However, pure silver bromide emulsions within the scope of the present invention only include emulsions having grains which are bound by predominantly (111) crystallographic faces.

Thus, the emulsions within the scope of the present invention may be constituted of a variety of grain shapes and sizes as long as the emulsion meets the above-described criteria. The mixed halide grains may be of any desired composition, and the relative halide composition of the grains is not critical.

The grains may be prepared by any conventional method known to the art including single jet, double jet, continuous procedures and the like.

In a particularly preferred embodiment, the grains in the silver halide emulsions of the present invention are so-called tabular grains; that is, they possess an aspect ratio, i.e., the ratio of diameter to thickness of greater than 1. Preferably, the aspect ratio is greater than 8:1, more preferably greater than 20:1. In a preferred embodiment, the thickness of the grain is less than about 0.15 micrometer, the diameter is at least about 0.6 and accounts for at least 50% of the projected area of all grains.

Any suitable natural or synthetic hydrophilic colloid conventionally employed in preparing silver halide emulsions may be employed as the dispersing medium in the emulsions of the present invention and may include proteins, cellulose derivatives, gelatin, gelatin derivatives, polysaccharides, gum arabic and casein.

Spectral sensitization of the grains is carried out employing sensitizing dyes which produce aggregates when adsorbed on the surface of the silver halide grains and a sharp sensitizing band. One or more spectral sensitizing dyes may be employed. The specific dyes are selected to obtain the region of the spectrum and shape of the spectral sensitivity curve desired. Spectral sensitizing dye aggregates are well known in the art, as illustrated by F. M. Hamer, Cyanine Dyes and Related Compounds, John Wiley & Sons, 1964, Chapter XVII; and T. H. James, The Theory of the Photographic Process, 4th Edition, MacMillan, 1977, Chapter 8.

While aggregating sensitizing dyes are known to the art and the method of applying such dyes to these grains is conventional in the art, it is critical that the dyes employed in the present invention are, in fact, aggregating dyes and that said dyes be applied to the grains in the presence of the silver halide complexing agent and prior to or simultaneous with chemical sensitization. The use of non-aggregating dyes substituted for aggregating dyes in the novel process of the present invention produce emulsions which exhibit slower speeds than the controls.

In an alternative embodiment, the silver halide grains may be washed by conventional emulsion washing techniques subsequent to spectral sensitization but prior to chemical sensitization.

In still another alternative embodiment, the grains may be sensitized with an additional spectral sensitizing dye subsequent to the chemical sensitization.

The silver halide complexing agent employed in the present invention must be capable of forming insoluble silver salts as well as charged silver complexes. Compounds which form only charged silver complexes are not suitable for use in the novel process of the present invention.

The concentration of silver halide complexing agent may vary over a relatively wide range and the specific concentrations may be selected at the option of the operator depending upon the degree of effect desired. Advantageous results may be obtained at a concentration of about 1-20 mmol of silver halide complexing agent per mol of silver, preferably 2-10 mmol per mol of silver, and more preferably 6 mmol per mol of silver.

The conditions employed in the contact of the silver halide by the silver halide complexing agent are selected to prevent any substantial Ostwald ripening. Thus, while the time of silver halide contact can range from substantially instantaneous contact to about 1 hour and the temperature from about 40° to 60° C., the combination of time and temperature is selected so that no Ostwald ripening occurs. In a preferred embodiment a temperature of 50° C. and a time of 15 minutes is employed.

As examples of suitable silver halide complexing agents useful in the present invention, mention may be made of compounds such as the thiocyanates, thioethers, 2-mercapto-benzothiazole, and 2,2'-(ethylenedithio)diethanol. In a preferred embodiment, metal thiocyanates are employed.

The following non-limiting examples illustrate the novel process of the present invention. In all the examples, the emulsions were stabilized after chemical sensitization with 4-hydroxy-6-methyl-1,3,3a,7-tetraazaindene and 1-(4-acetylphenyl)-2-tetrazoline-5-thione.

The following aggregating spectral sensitizing dyes were employed in the examples.

Dye A

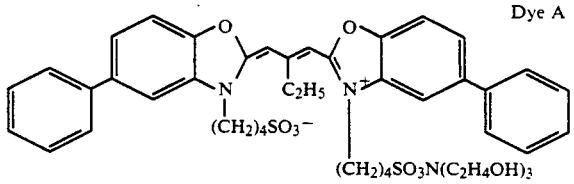

Dye B

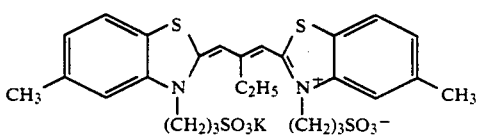

Dye C

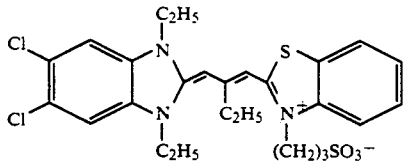

Dye D

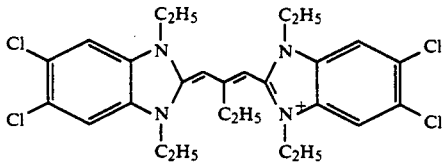

EXAMPLE A

Tabular Silver Bromide Emulsion

Into a 1.8 liter vessel containing 572 g. of water, 4.88 g. of gelatin and 6.35 g. of potassium bromide at 42° C. under agitation was double jetted a 1.5M solution of silver nitrate and a 1.68M solution of potassium bromide at the rate of 50 ml/min for 5 minutes with the temperature of the jetting solutions maintained at 19° C. During jetting the pH remains in the range of 4.8–4.9 and the pAg ranges from 10.3–10.4. The thus-formed nuclei are not Ostwald ripened, bulked or washed.

At 6.75 minutes after the nuclei are formed, 1.100 kg of nuclei were added to a 300 liter vessel containing 153.6 kg of water, 0.659 kg of inert, deionized gelatin, 0.133 kg. of potassium bromide at a temperature of 58.5° C. With the jetting solution held at a temperature of 42° C., a 1.5M solution of silver nitrate was jetted into the vessel under agitation at 1.8 l/min and a 1.5M solution of KBr was jetted into the vessel at 1.81 l/min for 28 minutes. During jetting the pH and pAg was maintained at 5.0 and 9.4 respectively.

At the end of the 28 minutes, the silver nitrate stream was stopped and the potassium bromide stream allowed to continue at the rate of 6 l/min until pAg (42° C.) reaches 10.6. At this point, the potassium bromide stream was stopped and the mixture is allowed to Ostwald ripen for 28 minutes at 58.5° C. The emulsion was then flocced and washed. In the last wash the emulsion is adjusted to a pH of 5.1 with potassium hydroxide. The emulsion is then bulked with inert, deionized gelatin to provide a gelatin:silver weight ratio of 0.44. The pH was adjusted to 6.2–6.3 and the pAg (42° C.) was adjusted to 7.8–8.0.

The grains had a thickness of about 0.11 micrometers, an average area-weighted diameter of about 3.2 micrometers, and an average aspect ratio of about 30:1.

Samples of the emulsion described in Example A were prepared as described above except that they were processed in the following manner.

EXAMPLE 1

Control

The thus-formed emulsion of Example A at 50° C. was contacted for 80 minutes with 18.0 μmol of sulfur per mole of silver from an aqueous solution of sodium thiosulfate and 4.25 μmol of gold per mole of silver from an aqeuous solution of 0.5% gold chloride in 1.25% potassium thiocyanate solution. Subsequent to chemical sensitization, sensitizing dye (Dye A) was added to the emulsion for 30 minutes at 50° C.

EXAMPLE 2

Control

Example 1 was except the emulsion was treated with 6 mmol/mol Ag of a 2% solution of potassium thiocyanate for about 15 minutes at a temperature of 50° C. prior to chemical and spectral sensitization.

EXAMPLE 3

Control

Example 1 was repeated except that Dye A was added to the emulsion prior to chemical sensitization rather than subsequent to said chemical sensitization.

EXAMPLE 4

Invention

The thus-formed emulsion of Example A was processed by contacting the emulsion with 6 mmol of potassium thiocyanate per mol of silver for about 15 minutes at a temperature of 42° C.–50° C.; spectrally sensitized by adding Dye A; and then chemically sensitized as described in Example 1.

A series of emulsions with varying amounts of levels of Dye A were prepared, coated on a cellulose triacetate support at a coverage of 3500 mg/m$^2$, dried, exposed for $10^{-2}$ seconds at 0.5 MCS through Wratten #36 and #47B filters, developed in D19 for 6 minutes at 20° C. and fixed. The speed was measured by a Macbeth TD 505 transmission densitometer. FIG. 1 is a plot of speed at a Density of 0.2 units above fog vs. dye level in μmol/mol Ag.

It will be seen that as dye loading increases, the speed drops off dramatically in the case of all of the controls, Examples 1–3. However, in the case of the emulsion of the present invention, Example 4, increased dye levels provides a significant and unexpected increase in speed; results exactly opposite to those provided by the control emulsions.

Figure 2:
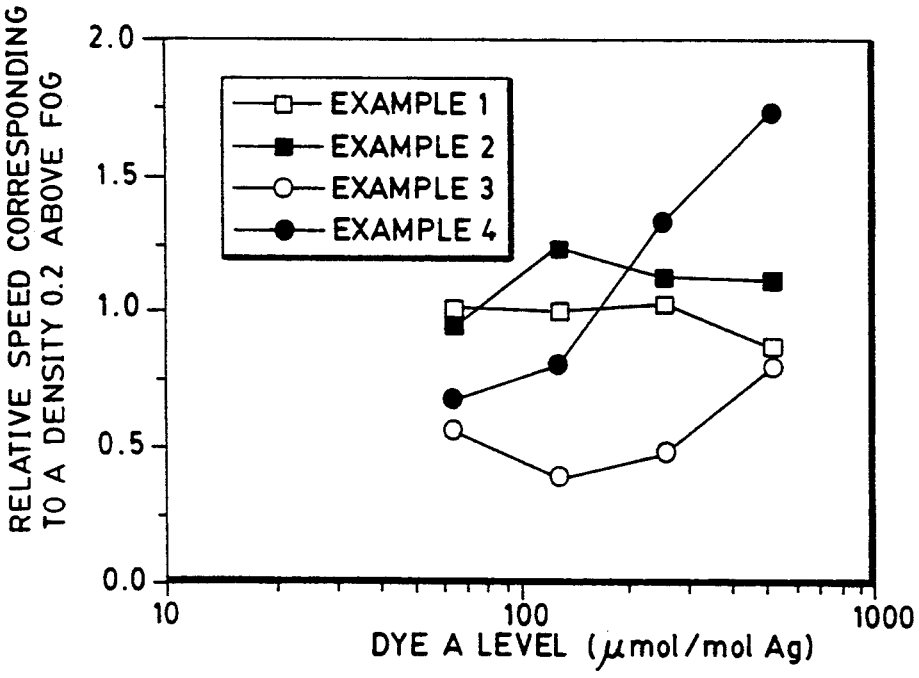

Coatings of Examples 1–4 as described above were subjected to an exposure of $10^{-2}$ seconds at about 0.5 MCS through a Wratten #15 filter and developed as described above. FIG. 2 shows a plot of speed at a density 0.2 units above fog vs. dye level. For control Examples 1 and 2 substantially no speed change is observed as dye level increases. Control Example 3, after an initial drop in speed as dye level increases show a slight increase in speed at a level of about 130 micromole of Dye A per mole of silver. However, the total speed increase only amounts to about a stop between the lowest and highest dye level and even the highest speed obtained is substantially lower than that obtained by the same level of dye in the emulsion of the invention, Example 4. In Example 4 a sharp and dramatic increase in speed was observed; a speed increase over the range of dye loading of 65–911 μmol/mole Ag.

In addition to the emulsions of Examples 1–4 which were predominantly tabular grains bounded by crystallographic faces (111), other, non-tabular emulsions were investigated. Example 5 shows the procedure of this invention carried in an emulsion with cubic grains. Example 6 shows the preparation of an emulsion with cubic grains with the silver solvent pretreatment and with chemical and spectral sensitization in the conventional order.

EXAMPLE 5

Cubic Emulsion—Invention

Into a make vessel containing 30 g. of derivatized gel, 16 g. of 2-methylimidazole, and 1970 g. of water were double jetted, with agitation, a 3M solution of potassium bromide and a 3M solution of silver nitrate. Starting at an initial flow rate of 11.11 ml/min, the solutions were jetted at a constant flow rate gradient of 0.741 ml/min$^2$ for 3 minutes maintaining the pAg below 7.8. At the end of the jetting period, the pH was lowered to 6.0 with 4N sulfuric acid and the temperature was lowered to 42° C. The emulsion was washed and bulked with gel to give a gel to silver weight ratio of 0.44. The pH was 6.3 and the pAg was 8.0. The emulsion was then treated with 18 μmol of potassium thiocyanate/m$^2$ of silver bromide surface at 50° C. for 10 min. At the same temperature 2.26 μmol of Dye B/m$^2$ of silver bromide surface was added and allowed to digest for 30 minutes. Sulfur and gold were then added at levels of 0.102 μmol/m$^2$ of silver bromide and 0.026 μmol/m$^2$ of silver bromide respectively. The emulsion was then allowed to ripen for an additional 50 minutes.

EXAMPLE 6

Cubic Emulsion—Control

The procedure of Example 5 was repeated except that the emulsion was gold and sulfur sensitized prior to spectral sensitization.

EXAMPLE 7

Octahedral Emulsion—Invention

Into a make vessel at 70° C. containing 30 g. of derivatized gel, 16 g. of 2-methylimidazole, 11.9 g KBr and 1970 g. of water were double jetted a 3M KBr solution and a 3M $AgNO_3$ solution. Starting a flow-rate of 11 11 ml/min, the silver nitrate and potassium bromide solutions were jetted at a constant flow rate gradient of 0.741 ml/min$^2$ for 30 minutes maintaining the pAg at 9.8–9.9. At 30 minutes into the jet, the flow rates of both streams were held constant at 33.33 ml/min for an additional 30 minutes. After jetting the pH is adjusted to 6.3 with 4N sulfuric acid and the temperature lowered to 42° C. The emulsion was then washed and bulked with gel to give a silver weight ratio of 0.44. The pH was 6.3 and the pAg was 9.24. The emulsion was then chemically and spectrally sensitized as described in Example 5.

EXAMPLE 8

Octahedral Emulsion—Control

The procedure of Example 7 was carried out except that the emulsion was gold and sulfur sensitized prior to spectral sensitization.

EXAMPLE 9

Octahedral Core/Shell Emulsion—Invention

Into a make vessel at 70° C. containing 30 g. of derivatized gel, 16 g. of 2-methylimidazole, 30 ml of 1M KBr, and 1970 g. of water were doubled jetted a 3M KBr solution and a 3M Ag $NO_3$ solution. Starting at a flow rate of 11.11 ml/min, the silver nitrate and potassium bromide solutions were jetted on a constant flow rate gradient of 0.741 ml/min for 5 minutes with the pAg maintained at 9.4. At 5 minutes, a second halide stream (2.88M KBr/0.21 MKI) was initiated having a starting flow rate of 0 ml/min and is allowed to increase at a constant flow rate gradient of 2.22 ml/min for 10 minutes. Simultaneously with the introduction of the second halide stream, the flow rate of the 3M KBr stream was decreased by jetting at a constant negative flow rate gradient of $-1.48$ ml/min$^2$ until the flow rate reached 0 ml/min$^2$ (10 min.) at which point the jet was shut off. During this period the silver nitrate stream was jetted at a constant flow rate gradient of 0.741 ml/min$^2$ starting at a flow rate of 11.11 ml/min. After 15 minutes into the the flow rate gradient of the iodobromide stream was changed to a constant value of 0.741 ml/min$^2$, and jetting was continued for an additional 15 minutes. After 30 minutes into the precipitation step the iodobromide stream is switched off and the KBr stream is switched on and jetted for 30 minutes at 33.33 ml/min. During the entire precipitation step the silver nitrate and halide streams were always maintained in balance.

The pH was then lowered to 6.0 with 4N sulfuric acid and the temperature is lowered to 42° C. The emulsion was then washed and bulked with gel to provide a gel to silver weight ratio of 0.44. The final pH was 6.3 and pAg of 9.0. The emulsion was then chemically and spectrally sensitized as described in Example 5 with the exception that the pAg was adjusted 8.7 prior to sensitization.

EXAMPLE 10

Octahedral Core/Shell Emulsion—Control

The procedure of Example 9 was carried out except that the emulsion was gold and sulfur sensitized prior to spectral sensitization. The emulsions were coated at 3500 mg/m$^2$, exposed with 1.7 MCS through a #26 Wratten Filter and speed values obtained as described above in connection with Examples 1–4.

Figure 3:
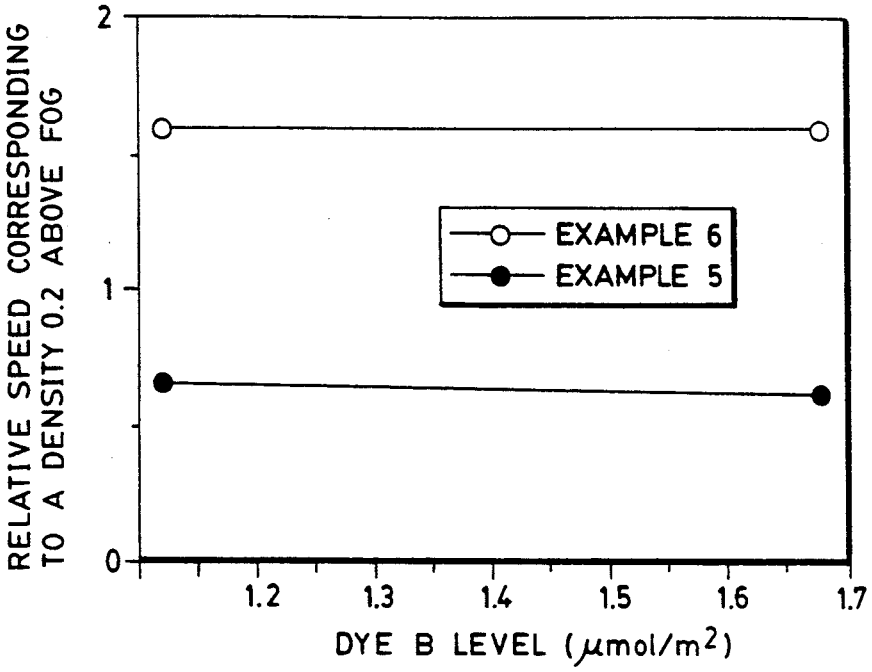
FIG. 3 shows plots of speed vs. sensitizing dye levels in cubic grain emulsions comparing the procedure of the present invention with a prior art procedure as applied to silver bromide cubic grain emulsions.

FIG. 3 is a plot of speed vs. dye level (Dye B) for a cubic emulsion prepared by prior art methods (Example 6) and according to the procedure of the present invention as described in Example 5. It will be noted that for both emulsions there is substantially no change in speed values obtained over the entire range of dye level investigated. However, it will be noted that because the cubic emulsions employed in Examples 5 and 6 do not contain (111) crystallographic faces that the speed of the emulsion prepared by the method of the present invention is substantially slower than the control.

Figure 4:
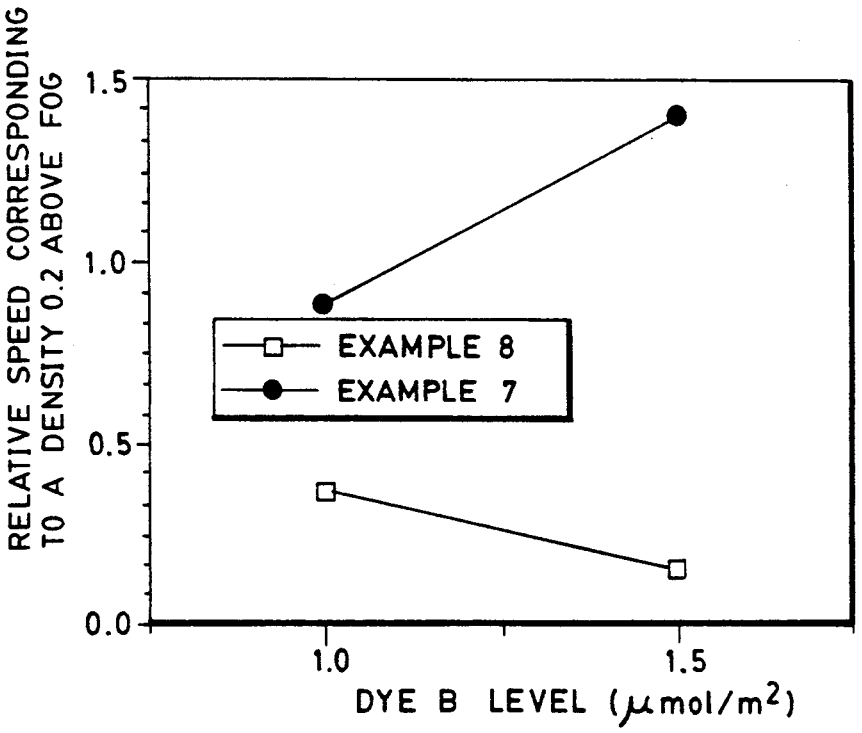
FIG. 4 shows plots of speed vs. sensitizing dye levels in silver bromide octahedral grain emulsions comparing emulsions of the present invention with control emulsions.

FIG. 4 is a plot of speed vs. dye level (Dye B) for octahedral emulsions prepared by a prior art method (Example 8) and Example 7 by the method of the present invention. The emulsion of the present invention shows an increase in speed throughout the range of dye loadings used, while the control emulsion shows a decrease in speed with increased dye loading. The emulsion of the present invention shows significantly greater speed than the control throughout the entire dye loading range.

Figure 5:
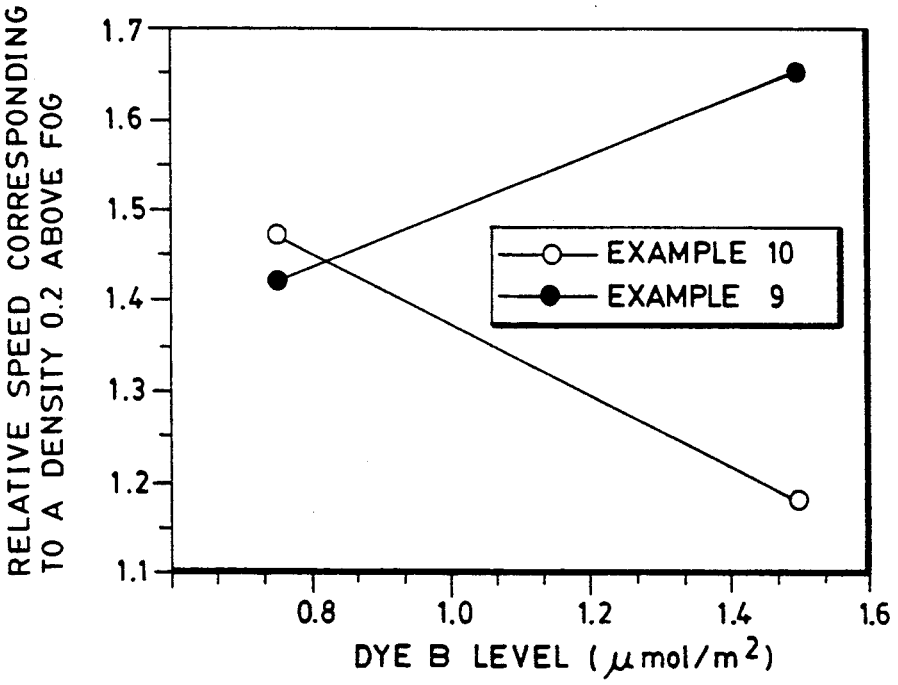
FIG. 5 shows plots of speed vs. sensitizing dye levels in octahedral iodobromide emulsions comparing emulsions of the present invention with control emulsions.

FIG. 5 is a plot of speed vs. dye level (Dye B) for iodobromide core-shell octahedral emulsions prepared by a prior art method (Example 10) and by the procedure of the present invention (Example 9). While the relative speeds of both emulsions are relatively similar at the lowest levels of dye loading, as the dye levels increase a substantial increase in speed is noted in the case of the emulsion of the present invention, Example 9, while a substantial drop-off in speed is observed in the case of the prior art emulsion, Example 10.

The following example illustrates the addition of a second sensitizing dye subsequent to chemical sensitization.

EXAMPLE 11

Tabular Grain Emulsion—Invention

The thus-formed emulsion of Example 4 was contacted with 449 μmol of Dye C/mol Ag and allowed to ripen an additional 30 minutes following which the emulsion was stabilized.

Example 11 illustrates an alternative embodiment wherein a second spectral sensitizing dye is added after chemical sensitization. An expanded spectral envelope is obtained as well as supersensitization.

EXAMPLE 12

Example 4 was repeated except that 3 mmol of 2, 2'-(ethylenedithio)diethanol per mole of silver was employed as the silver halide complexing agent instead of potassium thiocyanate.

EXAMPLE 13

Example 4 was repeated except that 3 mmol of 2-mercaptobenzothiazole per mole of silver was employed as the complexing agent.

The complexing agents employed in Examples 12 and 13 were found to be effective in the novel process of the present invention as shown by an increase in speed over the control.

EXAMPLE 14

AgClBr (10%) Cubic Grain Emulsion—Invention

Into a 5 liter vessell containing 1970 g. of water, 30 g. of phthalated gelatin, 16 g. of 2-methylimidazole and sufficient potassium bromide to provide a pAg of 9.0 were jetted a 3M silver nitrate solution and a 2.7M KBr/0.3M potassium bromide solution. Starting at a flow rate of 11.1 mls/min at a constant gradient of 0.741 mls/min$^2$ for 30 minutes and holding base stream at a constant flow rate of 33.3 mls/min for an additional 30 minutes. At the end of the jetting period the emulsion was cooled to 20° C. and the emulsion was washed and bulked with gel to provide a 0.44:1 gel to silver weight ratio. The pH was adjusted to 6.30 and the pAg to 8.0.

The emulsion was then treated for 10 minutes at 50° C. with 6 mmol of potassium thoicyanate per mol of silver for 10 minutes. Spectral sensitization was carried out by adding Dye B and mixing for 30 minutes. Chemical sensitization was carried out by adding 0.102 μmol of sodium thiosulfate/m$^2$ of total silver halide grain surface area and 0.026 μmol of gold chloride/m$^2$ of total silver halide surface area and digesting for 50 minutes.

EXAMPLE 15

Control

Figure 6:
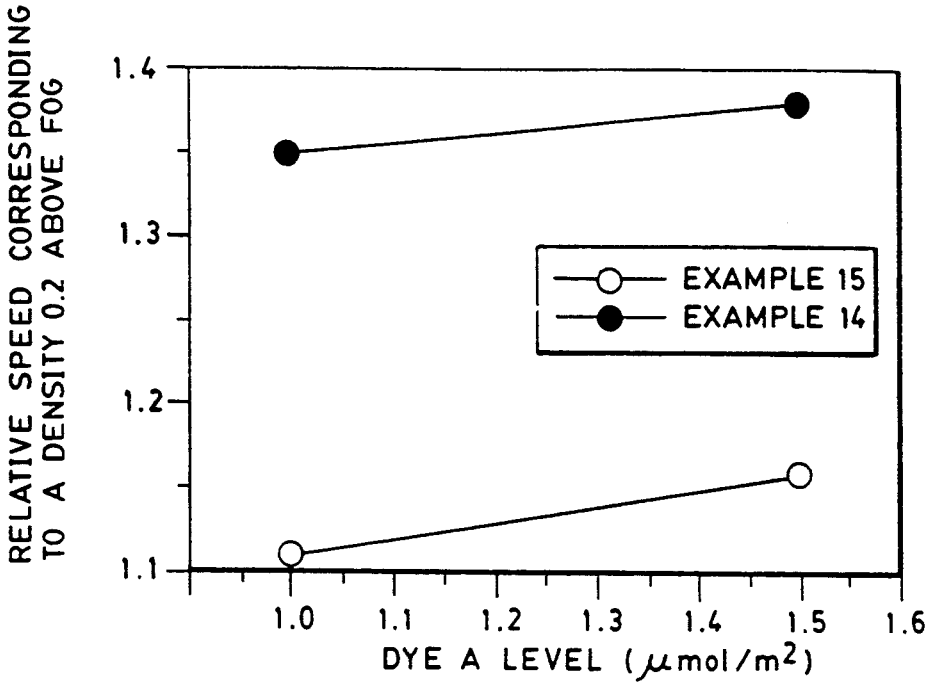
FIG. 6 shows a plot of speed vs. sensitizing dye levels in a silver chlorobromide cubic emulsion comparing an emulsion of the present invention with a control emulsion.

The procedure of Example 14 was repeated except that the emulsion was gold and sulfur sensitized prior to spectral sensitization. The emulsions were coated and exposed as described in Example 10. FIG. 6 is a plot of speed vs. dye level for the emulsions of Examples 14 and 15. A substantial speed increase at both dye levels is exhibited by the emulsion prepared by the novel method of the present invention compared to the control emulsion.

EXAMPLE 16

AgClBr (10%) Octahedral Grain Emulsion—Invention

Into a 5 liter vessel at 70° C. containing 1970 g. of water, 30 g. of phthalated gelatin, 16 g. of 2-methylimidazole and 3.9 g. of potassium bromide were jetted a 3.0M solution of silver starting at a flow rate of 11.11 ml/min for 30 minutes at a constant flow rate gradient of 0.741 ml/min$^2$ for 30 minutes followed by a constant jetting silver jetting of the silver nitrate solution for an additional 30 minutes at 33.33 ml/min. For the first 5 minutes a 3M KBr solution was jetted according to the same flow rate profile as the silver nitrate stream. At 5 minutes into a total jet time a second halide stream consisting 2.656M potassium bromide and 0.344M potassium chloride was jetted at a constant flow rate gradient of 2.22 ml/min$^2$ starting at 0 ml/min for 10 minutes while simultaneously the silver bromide stream was reduced to 0 ml/min flow rate by a constant flow rate gradient of $-1.48$ mls/min$^2$. At 15 minutes into the jetting sequence the bromide/chloride stream's flow rate gradient is changed to 0.741 mls/min$^2$ and the pure bromide stream is switched off. Ramp jetting continued for an additional 15 minutes. For the final 30 minutes of jetting the bromide/chloride stream had a constant flow rate of 33.33 mls/min. At the end of the jetting period the emulsion was cooled to 42.0° C., and the emulsion was washed and bulked with gel to give a 0.44:1 gel to silver ratio. The pH was adjusted to 6.30 and the pAg to 8.50.

The emulsion was then treated for 10 minutes at 50° C. with 6 mmol of potassium thiocyanate per mol of silver for 10 minutes. Special sensitization was carried out by adding Dye A and mixing for 30 minutes. Chemical sensitization was carried out by adding 0.102 μmol of sodium thiosulfate/m$^2$ of total silver halide grain surface area and 0.026 μmol of gold chloride/m$^2$ of total silver halide surface area and digesting for 50 minutes.

EXAMPLE 17

Control

The procedure of Example 16 was repeated except that the emulsion was gold and sulfur sensitized prior to spectral sensitization.

Figure 7:
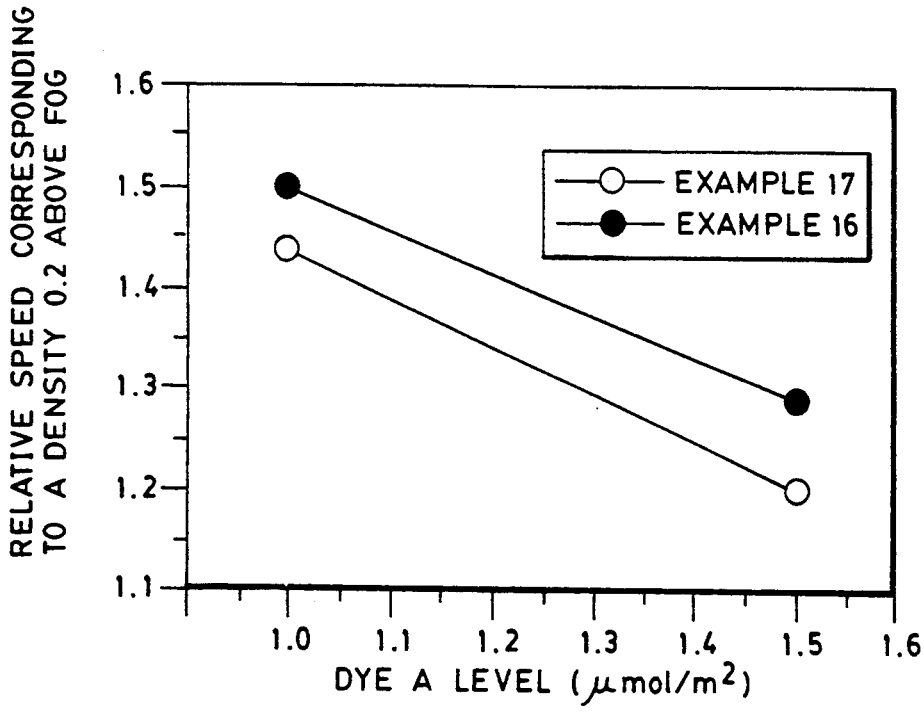
FIG. 7 shows a plot of speed vs. sensitizing dye levels in a silver chlorobromide octahedral emulsion comprraring an emulsion of the present invention with control emulsions.

The emulsions were coated and exposed as described in Example 10. FIG. 7 is a plot of speed vs. dye level for the emulsions of Examples 16 and 17. A speed increases at both dye levels is shown for the emulsions of the present invention compared to the control emulsions.

Additional optional additions, such as coating aids, hardeners, viscosity-increasing agents, stabilizers, preservatives and the like may also be incorporated in the emulsion formulation, according to conventional procedures known to the art.

The novel silver halide emulsions of the present invention may be employed in a variety of photographic products and processes including color and black and white processing, conventional wet development, silver transfer color diffusion transfer, graphic arts and the like.

We claim:

1. A method for preparing a silver halide emulsion which comprises the steps, in sequence, of:

a) forming an emulsion of silver bromide which is predominantly grains having (111) crystal faces or mixed halide grains of any morphology, in the presence of a hydrophilic colloid;

b) contacting said grains with a silver halide complexing agent at a concentration of 2–10 mmol of silver halide complexing agent per mol of silver; said silver halide complexing agent also forms insoluble silver salts; and, in the presence of said silver halide complexing agent, c) spectrally sensitizing said grains with at least a first aggregating spectral sensitizing dye; and d) chemically sensitizing said grains; wherein said spectral sensitization is carried out prior to or simultaneous with said chemical sensitization.

2. The method of claim 1 wherein said grains are washed prior to said contact with said silver halide complexing agent.

3. The method of claim 1 wherein said hydrophilic colloid is gelatin.

4. The method of claim 1 wherein said grains are physically ripened prior to said contact with said silver halide complexing agent.

5. The method of claim 3 wherein said washing is carried out by floc washing.

6. The method of claim 2 wherein said washing is carried out by ultrafiltration.

7. The method of claim 1 wherein a second sensitizing dye is added to said emulsion subsequent to said chemical sensitization.

8. The method of claim 1 wherein said silver halide grains are tabular grains.

9. The method of claim 1 wherein said silver halide grains are cubic grains.

10. The method of claim 1 wherein said grains are octahedral grains.

11. The method of claim 8 wherein said grains have an aspect ratio of at least 5:1.

12. The method of claim 8 wherein said grains have an aspect ratio of at least 8:1.

13. The method of claim 8 wherein said grains have an aspect ratio of at least 20:1.

14. The method of claim 1 wherein said emulsion is a core/shell emulsion.

15. The method of claim 1 wherein said grains are washed subsequent to said spectral sensitization and prior to said chemical sensitization.

* * * * *